US010245466B2

(12) United States Patent
Uygan

(10) Patent No.: US 10,245,466 B2
(45) Date of Patent: Apr. 2, 2019

(54) FOOT STRETCHING AND STRENGTHENING APPARATUS

(71) Applicant: Viktor Uygan, Mission Viejo, CA (US)

(72) Inventor: Viktor Uygan, Mission Viejo, CA (US)

( * ) Notice: Subject to any disclaimer, the term of this patent is extended or adjusted under 35 U.S.C. 154(b) by 137 days.

(21) Appl. No.: 15/298,161

(22) Filed: Oct. 19, 2016

(65) Prior Publication Data

US 2018/0104538 A1 Apr. 19, 2018

(51) Int. Cl.

| | |
|---|---|
| ***A61H 1/02*** | (2006.01) |
| ***A63B 21/00*** | (2006.01) |
| ***A63B 21/04*** | (2006.01) |
| ***A63B 23/00*** | (2006.01) |
| ***A63B 23/10*** | (2006.01) |
| ***A63B 21/002*** | (2006.01) |
| ***A63B 21/055*** | (2006.01) |
| ***A63B 23/035*** | (2006.01) |

(52) U.S. Cl.

CPC ..... *A63B 23/10* (2013.01); *A61H 1/02* (2013.01); *A61H 1/0266* (2013.01); *A63B 21/0023* (2013.01); *A63B 21/00047* (2013.01); *A63B 21/0414* (2013.01); *A63B 21/0552* (2013.01); *A63B 21/0557* (2013.01); *A63B 23/03508* (2013.01); *A63B 2023/006* (2013.01); *A63B 2225/09* (2013.01)

(58) Field of Classification Search

CPC ..... A63B 23/10; A63B 2023/006; A63B 21/04–21/0407; A63B 21/0414

See application file for complete search history.

(56) References Cited

U.S. PATENT DOCUMENTS

| | | | | |
|---|---|---|---|---|
| 1,989,899 | A * | 2/1935 | Vance | A63B 23/10 482/79 |
| 6,042,520 | A | 3/2000 | Cantero | |
| 6,077,203 | A * | 6/2000 | Lay | A63B 23/085 482/79 |
| 6,592,499 | B2 | 7/2003 | Parker | |
| 2013/0226052 | A1 | 8/2013 | Niggemann | |
| 2014/0221173 | A1 | 8/2014 | Crabtree et al. | |
| 2014/0342881 | A1 | 11/2014 | Almarales | |
| 2016/0023038 | A1 | 1/2016 | Daffidis | |

* cited by examiner

*Primary Examiner* — Jennifer M Deichl

(74) *Attorney, Agent, or Firm* — Greenberg Traurig, LLP

(57) ABSTRACT

An apparatus for stretching and strengthening the forefoot of a user may include a pair of parallel hollow tubular leg members each having a first and second end and having a cross bore adjacent each of the first and second ends, a barrel bridging and joining the pair of leg members and positioned intermediate the first and second end of each leg member, the barrel providing a support for the arch of a user's forefoot for flexing and strengthening the forefoot over the barrel, a pair of extenders each adapted to removably attach to and extend from one of the leg members, and a removable elastic band or sleeve positionable over the leg members intermediate the first end and the barrel to hold the toes of the user's forefoot over the barrel during flexing of the forefoot.

6 Claims, 5 Drawing Sheets

FOOT STRETCHING AND STRENGTHENING APPARATUS

BACKGROUND OF THE DISCLOSURE

This disclosure relates generally to exercise devices and more particularly to an apparatus for strengthening and stretching a user's forefoot. Skilled dancers, for example, ballet dancers rely a great deal on the strength and flexibility of their feet to perform. Much care is given to ensure that the dancer's feet are properly warmed and ready before dancing. Conventional devices for strengthening and stretching the foot are large and bulky. They are typically stored in one room for shared use by various dancers. Some facilities, for example dance studios, may not have such devices. As may be imagined, these devices cannot be conveniently carried and taken with a dancer to the studio or event of their choice. Therefore there is a need for a simple, compact device that a user such as a dancer may transport and utilize to stretch her forefoot and strengthen her overall foot conformation.

SUMMARY OF THE DISCLOSURE

Embodiments of the present disclosure provide an apparatus that can be conveniently carried for strengthening and stretching the foot. An apparatus for stretching and strengthening the foot comprises a pair of leg members coupled together by a curved barrel that bridges the pair of leg members and fastens the leg members together in spaced parallel relation. The barrel may be positioned intermediate the first and second end of each leg member. The barrel provides support for the arch of the foot as the forefoot is flexed and bent over the barrel. An elastic band may be positioned intermediate the first end of the apparatus over the leg members and over the user's forefoot and toes to hold the toes of the foot during flexing of the foot. The barrel shape is preferably asymmetric about its axis between the leg members so that it conforms to the shape of a user's arch so that proper leg to foot alignment is maintained while the forefoot is being stretched.

An apparatus for stretching and strengthening the forefoot of a user in accordance with an exemplary embodiment includes a pair of parallel leg members having first and second ends, a curved barrel bridging the pair of leg members and positioned intermediate the first and second end of each leg member, the barrel providing a support for the arch of a user's forefoot for flexing and strengthening the forefoot over the barrel; and a removable elastic band positionable over the leg members intermediate the first end and the barrel to hold the toes of the user's forefoot over the barrel during flexing of the foot. The barrel has a first diameter at a base end of the barrel and a smaller second diameter at an opposite end of the barrel. The barrel diameter preferably expands from the first diameter before reducing to the smaller second diameter at the opposite end of the barrel.

A pair of extenders each adapted to attach to and extend from one of the leg members are preferably included for a user to grasp while using the apparatus. Each leg member may be a hollow tube having a cross bore at each first and second end and each extender adapted to fit within the hollow tube and extend therefrom. Each of the extenders is preferably sized to fit within one of the cross bores.

One exemplary apparatus for stretching and strengthening the forefoot of a user in accordance with the disclosure includes a pair of parallel leg members each having first and second ends, a curved barrel bridging and joining the pair of leg members and positioned intermediate the first and second end of each leg member, the barrel providing a support for the arch of a user's forefoot for flexing and strengthening the forefoot over the barrel, a pair of extenders each adapted to attach to and extend from one of the leg members, and a removable elastic band positionable over the leg members intermediate the first end and the barrel to hold the toes of the user's forefoot over the barrel during flexing of the forefoot. Each leg member preferably is a hollow tube having a cross bore adjacent each of the first and second ends. Each extender is a rod having a plurality of spaced clevis bores each for receiving a clevis pin to retain the extender in one of the leg members, and each extender is sized to fit into one of the leg members and through one of the cross bores. Each extender can be positioned within one of the leg members or at a right angle to the one of the leg members.

An embodiment of the apparatus for stretching and strengthening the forefoot of a user in accordance with the present disclosure may be viewed as including a pair of parallel hollow tubular leg members each having a first and second end and having a cross bore adjacent each of the first and second ends, a barrel bridging and joining the pair of leg members and positioned intermediate the first and second end of each leg member, the barrel providing a support for the arch of a user's forefoot for flexing and strengthening the forefoot over the barrel, a pair of extenders each adapted to removably attach to and extend from one of the leg members, and a removable elastic band positionable over the leg members intermediate the first end and the barrel to hold the toes of the user's forefoot over the barrel during flexing of the forefoot. Preferably the barrel is fastened to each leg member via screws to maintains the leg members in parallel relation. The barrel has a large end fastened to one of the leg members and a narrower end each fastened to the other of the pair of leg members. The cross bores are sized to receive one of the extenders therethrough. Each extender has a plurality of clevis bores for receiving a clevis pin to removably fasten the extender to the leg member.

Further features, advantages and characteristics of the embodiments of this disclosure will be apparent from reading the following detailed description when taken in conjunction with the drawing figures.

DETAILED DESCRIPTION

Broadly, embodiments of the subject technology provide an apparatus for stretching and strengthening the foot. The apparatus supports the arch of the foot while permitting the user to stretch the foot and adjacent leg muscles, fascia, and tendons through a wide range of motion.

Figure 1:
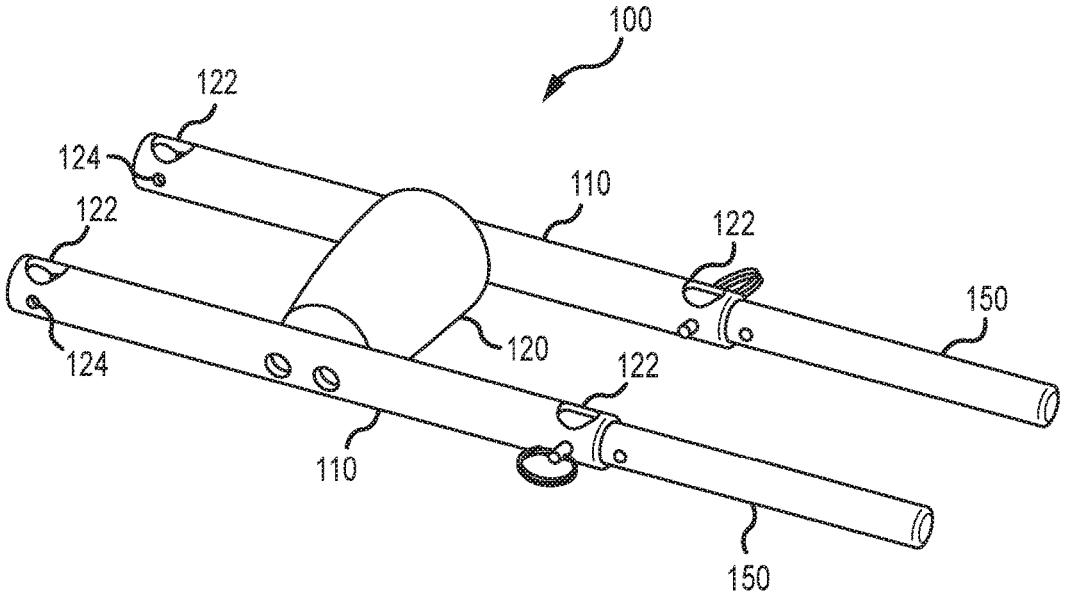
FIG. 1 is a perspective view of a foot stretching apparatus in accordance with the present disclosure without the elastic band.
Figure 2:
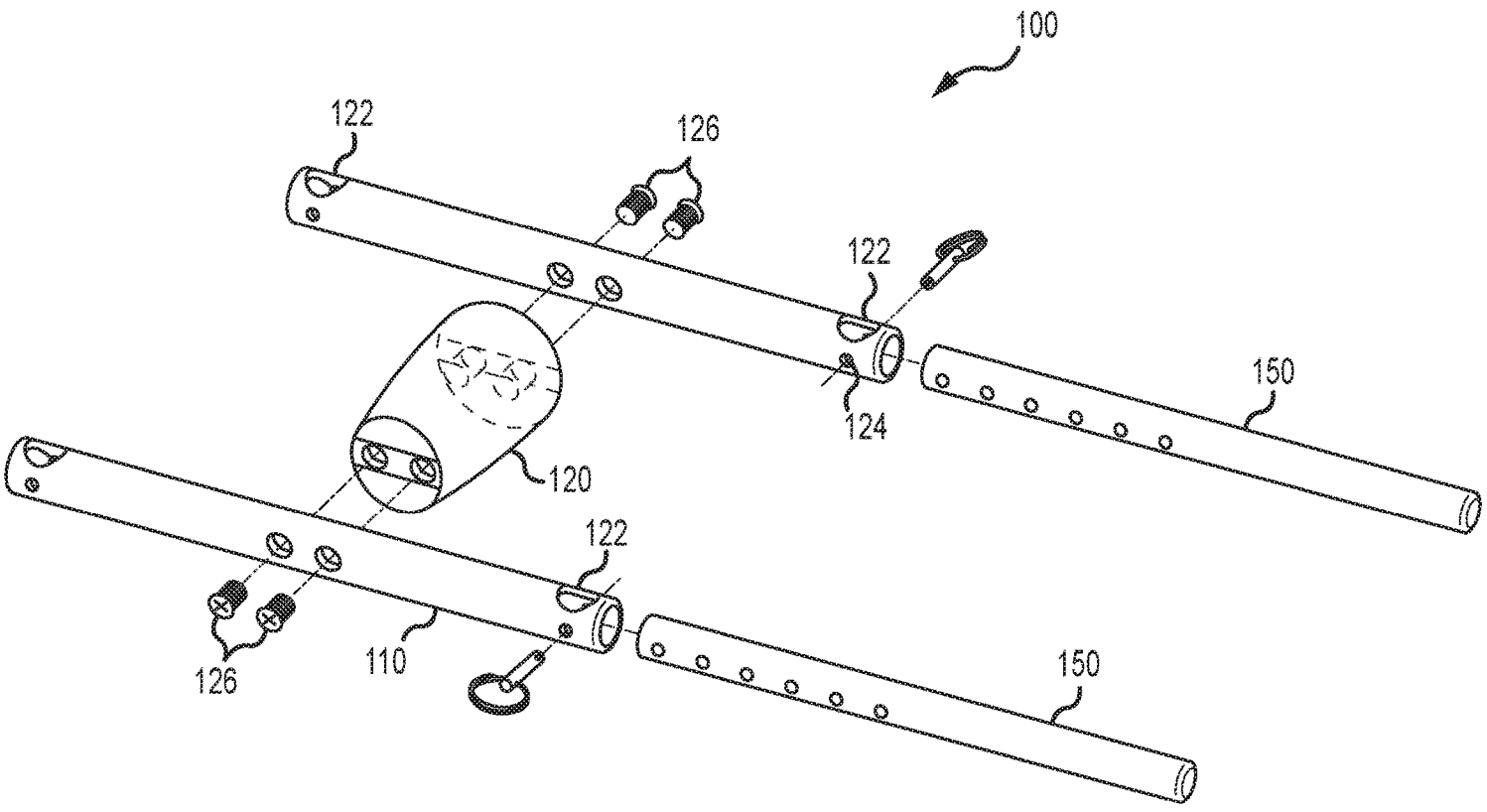
FIG. 2 is an exploded view of the apparatus of FIG. 1.

Referring now to FIG. 1, an apparatus 100 is shown in accordance with an exemplary embodiment of the subject disclosure. The apparatus 100 includes a pair of legs or leg members 110 and a barrel 120 bridging the legs 110. The barrel 120 may be frusto-conical. Preferably the barrel 120 has one end with a diameter larger than the other end and a convex curved external shape therebetween. The external shape of the barrel 120 may preferably complement the transverse arch shape of a user's foot so that, in use, the user's leg is in parallel alignment with the pair of apparatus leg members 110. Preferably the barrel 120 is fastened to each leg midway between ends of the legs 110. The barrel 120 is preferably fixed to the legs 110 so it does not move or rotate about its longitudinal axis. In the embodiments shown, the barrel 120 is screwed to the leg members 110 via a pair of screws 126, shown in FIG. 2, so that the barrel 120 cannot rotate about the leg members 110.

Each leg 110 is a straight hollow tube about 12 inches long made of metal or plastic having a through cross bore 122 adjacent each end and a clevis pin bore 124 positioned 90° to the cross bore 122. This cross bore 122 has a diameter approximately equal to the internal cross section of the leg 110 such that an extender rod 150 may be easily inserted either axially into the tube 122 or through the cross bore 122. Legs 110 are generally arranged parallel to each other and spaced apart by the barrel 120. An elastic sleeve or band 130 is wrapped around the legs 110 and positioned intermediate the distal end of the legs 110 and the barrel 120.

Figure 3:
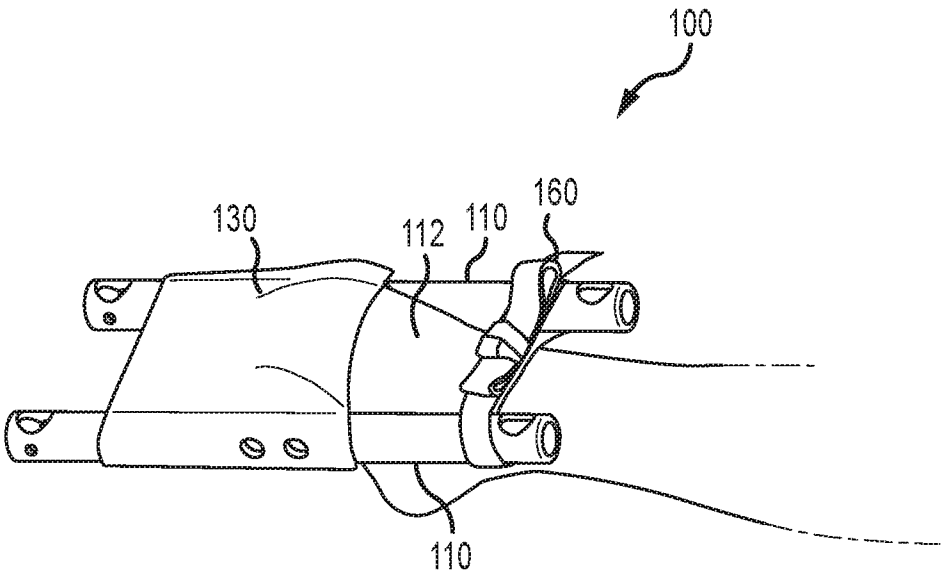
FIG. 3 is a perspective view of one embodiment of the apparatus of FIG. 1 in place on a user's leg.
Figure 4:
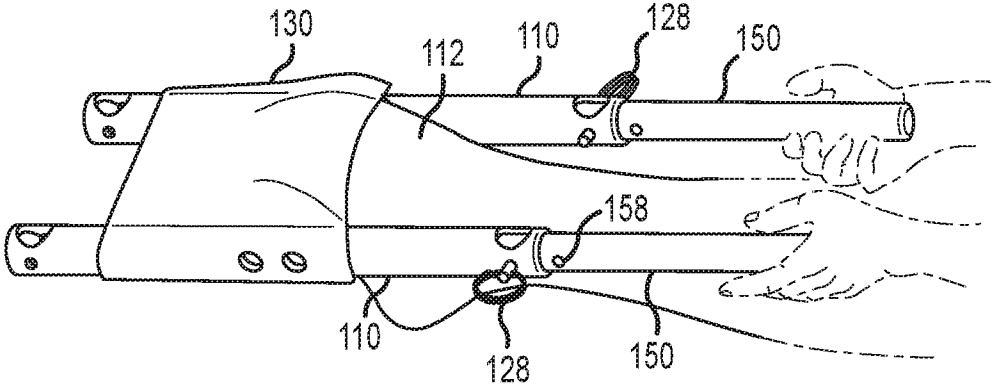
FIG. 4 is a perspective view of the apparatus of FIG. 1 with the extender in each leg member in use on a user's leg.

Referring now to FIG. 3, the apparatus 100 is shown in position on a user's forefoot 112 beneath band 130 with the forefoot 112 positioned over the barrel 120 and held in a stretch configuration with an optional strap 160 around the proximal ends of the leg members 110. In FIG. 4, the apparatus 100 is shown with extender rods 150 axially extending from within the proximal ends of the leg members 110. These extender rods 150 are each preferably inserted into each of the proximal ends of the leg members 110 and retained therein by a clevis pin 128 inserted through the clevis bore 124 through the proximal end of the each of the legs 110 and through one of a plurality of cross bores 152 through the extender rod 150.

Referring now to FIG. 3 use of the apparatus 100 is shown. A user may use the apparatus 100 by inserting his or her foot between the legs 110 and resting the arch of the foot over the barrel 120, and beneath the elastic sleeve or band 130. In an exemplary use, the medial longitudinal arch of the user's forefoot is positioned over the wider diameter end of the barrel 120. The lateral longitudinal arch of the user's forefoot rests on the smaller diameter end of the barrel 120. The toes and ball of the foot are preferably held in place in a stretch by the elastic band 130. The heel is primarily out of contact with the barrel 120. A user may thus flex his or her foot so that the heel pivots around the circumference of the barrel 120 to varying degrees. In addition, the apparatus 100 may be flipped over for use on the user's other foot so the aforementioned arches are placed in the same manner. The foot may be flexed repeatedly for strength training or the foot may be held in place and torque administered to promote stretching and flexibility. The strap 160 may be tied to the open proximal end of the apparatus 100 to provide a flexible counter barrier maintaining the user's shin in place as the user's heel flexes around the barrel 120. In this embodiment, it may be appreciated that the foot may be flexed without the need of the user's hands to aid in the process.

Referring now to FIG. 4, the apparatus 100 is shown with the extenders 150 coupled axially to the legs 110. The user may comfortably grasp ends of the extenders 150 to provide a counter resistance and increase torque on the foot when flexed. This may increase flexibility not only on the foot but also in the surrounding muscle and connective tissue.

Figure 5:
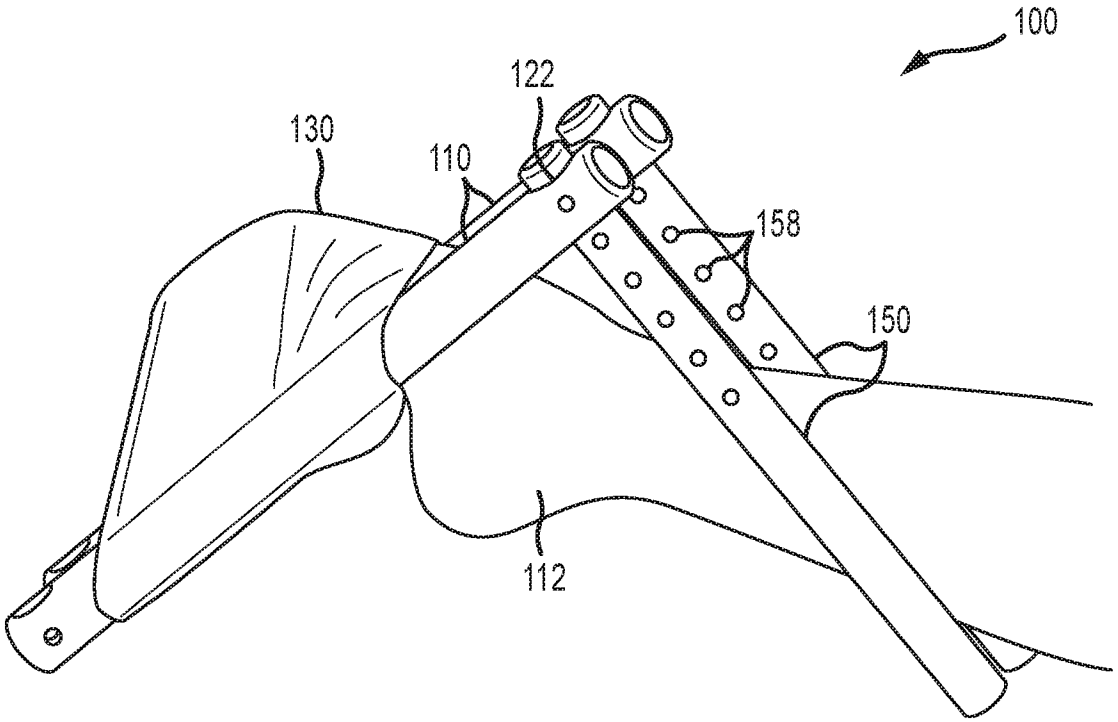
FIG. 5 is a perspective view of the apparatus of FIG. 4 with the extenders in an alternate position on a user's leg during use.

FIG. 5 shows the extenders 150 connected to the leg members 110 through the cross bores 122. In this configuration, the extenders 150 are at right angles to the leg members 110 and operate as standalone supports providing another method of flexing the foot. The leg extenders 150 include a series of openings 158 so that the length of the extenders 150 from the leg members 110 may be adjusted. FIG. 4 shows the extenders 150 as supports pointed toward the user so the user may grasp the extenders 150 for a different series of movements and stretching. It may be appreciated that the apparatus 100 provides a full range of motion to a flexed foot that is particularly beneficial to dancers who require more flexing than the general public. In addition, the apparatus 100 is fully collapsible and the extenders 150 and strap 160 may be easily disassembled and reassembled with the rest of the apparatus 100 for convenient transport in a personal bag.

The optional strap 160 may be made of a cotton canvas or nylon strap material. Also, a Theraband elastic sheet material may be used. The band 130 is preferably made of a stretchable elastic sheet material such as a natural rubber or synthetic rubber. However, any flexible fabric or sleeve material may be utilized to produce the band 130. The apparatus 100 may be utilized by athletes, dancers and others desiring to strengthen their forefeet as well as exercise the user's ankles. Furthermore, the apparatus 100 may be used by physical therapists in a rehab clinic environment to create improved range of motion to a patient's ankle joint as well as metatarsals, and may be utilized to address problems like Achilles tendonitis or planter fasciitis, for example, and may be used by fitness trainers and anyone desiring to improve flexibility of the foot.

Persons of ordinary skill in the art may appreciate that numerous design configurations may be possible to enjoy the functional benefits of the inventive systems. For example, although in the figures shown, the extenders 150 are positioned within the proximal ends of the legs 110 the extenders may alternatively be inserted into the distal end openings of the legs 110 for a different amount of stretch. Thus, given the wide variety of configurations and arrangements of embodiments of the present invention the scope of the invention is reflected by the breadth of the claims below rather than narrowed by the embodiments described above. Also, the addition of powered sub-woofers to augment an embodiment will not invalidate the claims of this invention.

Therefore, all such changes, alternatives and equivalents in accordance with the features and benefits described herein, are within the scope of the present disclosure. Such changes and alternatives may be introduced without departing from the spirit and broad scope of this disclosure as defined by the claims below and their equivalents.

What is claimed is:

1. An apparatus for stretching and strengthening the forefoot of a user, comprising:

a pair of parallel leg members having first and second ends, wherein each lea member is a hollow tube having a cross bore at each first and second end;

a curved barrel bridging the pair of leg members and positioned intermediate the first and second end of each leg member, the barrel providing a support for the arch of a user's forefoot for flexing and strengthening the forefoot over the barrel; and a removable elastic band positionable over the leg members intermediate the first end and the barrel to hold the toes of the user's forefoot over the barrel during flexing of the foot, further comprising a pair of extenders, each extender adapted to fit within the hollow tube and extend therefrom, and wherein each of the extenders is sized to fit within one of the cross bores.

2. The apparatus according to claim 1 wherein the barrel has a convex outer shape with a large end and a small end each fastened to one of the leg members.

3. An apparatus for stretching and strengthening the forefoot of a user, comprising:

a pair of parallel leg members each having first and second ends;

a convex barrel bridging and joining the pair of leg members and positioned intermediate the first and second end of each leg member, the barrel providing a support for the arch of a user's forefoot for flexing and strengthening the forefoot over the barrel;

a pair of extenders each adapted to attach to and extend from one of the leg members; and a removable elastic band positionable over the leg members intermediate the first end and the barrel to hold the toes of the user's forefoot over the barrel during flexing of the forefoot, wherein each leg member is a hollow tube having a cross bore adjacent each of the first and second ends, and wherein each extender is a rod having a plurality of spaced clevis bores each for receiving a clevis pin to retain the extender in one of the leg members.

4. The apparatus according to claim 3, wherein each extender is sized to fit into one of the leg members and through one of the cross bores.

5. An apparatus for stretching and strengthening the forefoot of a user, comprising:

a pair of parallel hollow tubular leg members each having a first and second end and having a cross bore adjacent each of the first and second ends;

a convex barrel bridging and joining the pair of leg members and positioned intermediate the first and second end of each leg member, the barrel providing a support for the arch of a user's forefoot for flexing and strengthening the forefoot over the barrel;

a pair of extenders each adapted to removably attach to and extend from one of the leg members; and a removable elastic band positionable over the leg members intermediate the first end and the barrel to hold the toes of the user's forefoot over the barrel during flexing of the forefoot, wherein the cross bores are sized to receive one of the extenders therethrough.

6. The apparatus according to claim 5 wherein each extender has a plurality of clevis bores for receiving a clevis pin to removably fasten the extender to the leg member.

* * * * *